US011316260B2

(12) United States Patent
Schaupmann et al.

(10) Patent No.: US 11,316,260 B2
(45) Date of Patent: Apr. 26, 2022

(54) ANTENNA ARRANGEMENT FOR AN AIRCRAFT

(71) Applicant: AIRBUS OPERATIONS GMBH, Hamburg (DE)

(72) Inventors: Christian Schaupmann, Bad Laer (DE); Markus Altmann, Werder (DE)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 17/158,637

(22) Filed: Jan. 26, 2021

(65) Prior Publication Data

US 2021/0242576 A1 Aug. 5, 2021

(30) Foreign Application Priority Data

Jan. 31, 2020 (DE) ..... 10 2020 102 535.1

(51) Int. Cl.
*H01Q 1/28* (2006.01)
*H01Q 1/22* (2006.01)

(52) U.S. Cl.
CPC ..... *H01Q 1/286* (2013.01); *H01Q 1/2283* (2013.01)

(58) Field of Classification Search
CPC ..... H01Q 1/286; H01Q 1/2283
USPC ..... 343/708
See application file for complete search history.

(56) References Cited

U.S. PATENT DOCUMENTS

| | | | | |
|---|---|---|---|---|
| 7,274,336 | B2 * | 9/2007 | Carson | H01Q 1/286 343/705 |
| 10,644,384 | B1 * | 5/2020 | Ozdemir | H01Q 1/28 |
| 2015/0130672 | A1 * | 5/2015 | Cordone | H01Q 1/28 343/705 |
| 2019/0245264 | A1 * | 8/2019 | Schaupmann | H01Q 1/085 |

FOREIGN PATENT DOCUMENTS

| | | |
|---|---|---|
| DE | 40 41 458 A1 | 1/1998 |
| DE | 103 56 395 A1 | 9/2005 |

OTHER PUBLICATIONS

German Search Report for Application No. 10 2020 102 535.1 dated Sep. 1, 2020.

* cited by examiner

*Primary Examiner* — Peguy Jean Pierre
(74) *Attorney, Agent, or Firm* — Jenkins, Wilson, Taylor & Hunt, P.A.

(57) ABSTRACT

An antenna arrangement for an aircraft for fastening to an outer side of an exterior skin of the aircraft has a body and side wall sections and a connecting section. The body is U-shaped or H-shaped if viewed from a predefined direction and can be flowed through with a low aerodynamic drag by a flow along the predefined direction. The antenna arrangement has one or more antennas in the form of a printed circuit board and of which each is fastened to the body and is fastenable directly to the outer side of the aircraft exterior skin at two first edges of the side wall sections which form two free ends of the U-shape or H-shape on a first side of the connecting section or, for the U-shape, on the connecting section and/or regions of the side wall sections, which regions adjoin the connecting section directly as the predefined direction is parallel to the flow direction during flight.

14 Claims, 6 Drawing Sheets

ANTENNA ARRANGEMENT FOR AN AIRCRAFT

CROSS-REFERENCE TO RELATED APPLICATION

This application claims priority to German Patent Application DE 102020102535.1 filed Jan. 31, 2020, the entire disclosure of which is incorporated by reference herein.

TECHNICAL FIELD

The present application relates to an antenna arrangement for an aircraft for fastening to an outer side of an exterior skin of the aircraft, and to a corresponding antenna arrangement of an aircraft, which antenna arrangement has one or more antennas and a body which is permeable at least in sections for radio waves which are emitted by the antennas, and to an aircraft with an antenna arrangement of this type.

BACKGROUND

Aircraft typically have one or more antenna arrangements, via which a radio connection can be established between the aircraft and external apparatuses or users on the ground or in the air, such as, for example, other aircraft or satellites.

In the prior art, antenna arrangements of this type have been mounted, inter alia, on the outside of the aircraft fuselage, with the result that they project to the outside from the aircraft fuselage into the air which surrounds the latter. The antenna arrangements have a radome which is formed by way of a body and is fastened via a metallic base plate to the aircraft fuselage. The metallic base plate is fastened to an arrangement of fastening elements which is provided on the exterior skin, and the radome is for its part fastened to the base plate. One or more mechanically rotatable or other antenna elements which are usually mounted on the metallic base plate are arranged in the cavity which is defined by way of the radome and the metallic base plate. The cavity is dimensioned in such a way that it provides sufficient space for the movement of the antenna elements. The radome can be closed or can have ventilation openings which make it possible for air to escape to the outside from the cavity.

The aerodynamic drag is increased by way of the radome which projects to the outside into the air which surrounds the aircraft fuselage, which increases the fuel consumption during operation. Moreover, the fuel consumption is increased further by way of the relatively high weight of the metallic base plate which projects together with the radome into the surrounding air and therefore additionally increases the aerodynamic drag. In addition, the installation complexity of antenna arrangements of this type is relatively high, and they have relatively high costs.

SUMMARY

It is therefore an object of the disclosure herein to provide an antenna arrangement for an aircraft, which antenna arrangement is of simple and inexpensive construction, makes a low drag of the aircraft possible, is easy to install and to maintain, and has a low weight, and to provide an aircraft with an antenna arrangement of this type.

This object is achieved by an antenna arrangement for an aircraft with features disclosed herein. Advantageous embodiments of the antenna arrangement and the aircraft are disclosed herein.

According to the disclosure herein, an antenna arrangement for an aircraft is provided, which antenna arrangement is adapted for fastening to an outer side of an exterior skin of the aircraft, in particular in the region of the fuselage of the aircraft, and a corresponding antenna arrangement of an aircraft is also provided. The antenna arrangement has a body which is configured from one or more non-metallic materials, and one or more antennas which are provided in the form of a printed circuit board and can preferably be oriented electronically, in particular, and are also called printed circuit board antennas. Each of the antennas is fastened to or mounted on the body. The material of the body is preferably permeable to radio waves completely or at least in the region of each of the antennas, which radio waves are emitted and/or received by the antennas.

The body has two planar or curved plate-shaped side wall sections and a connecting section which connects them and is preferably likewise plate-shaped in a planar or curved manner. The two side wall sections can in each case be closed continuously or can have one or more openings or indentations. The same applies to the connecting section. The side wall sections and the connecting section are arranged in such a way that the body is U-shaped or H-shaped if it is viewed from a predefined direction. In other words, if it is viewed from the predefined direction, the body has a form which has two elongate lateral sections, of which each is formed by way of another one of the two side wall sections and which are connected to one another by way of a further section which is formed by way of the connecting section. In the case of the U-shape, the further section connects the two elongate sections at two ends which lie opposite one another. In the case of the H-shape, the further section connects the two elongate sections in regions which lie between the two ends of the lateral sections. The U-shape or H-shape does not have to be symmetrical. In particular, the lateral sections do not have to be straight or run parallel to one another. In the case of the H-shape, moreover, the further section does not have to be connected to the lateral sections centrally between the ends of the lateral sections.

Each of the antennas is fastened to or mounted on one of the side wall sections or the connecting section. By way of the different alignment or orientation of the side wall sections and the connecting section, various antennas can be mounted in various orientations in a simple way and without additional complexity, with the result that they can cover different angular ranges in a targeted and selective manner.

The antenna arrangement is adapted so as to be fastened directly to the outer side of the exterior skin of the aircraft at two first edges of the side wall sections which form the two free ends of the U-shape or two free ends of the H-shape on a first side of the connecting section, in such a way that the predefined direction is parallel to the flow direction during the flight of the aircraft. Then, in the case of the U-shape, a flow duct which is closed perpendicularly with respect to the predefined direction is formed by way of the body and the exterior skin, through which flow duct the air can flow through the body and therefore the antenna arrangement overall in the predefined direction. In the case of the H-shape, a first corresponding closed flow duct and a second flow duct are formed, which second flow duct is open on one side perpendicularly with respect to the predefined direction, and the air can flow through the body and therefore the antenna arrangement overall in the predefined direction through the first and the second flow duct. This embodiment is preferred. As an alternative or in addition, however, it is also possible that, in the case of the U-shape, the antenna arrangement is adapted so as to be fastened directly to the outer side of the exterior skin of the aircraft on the connecting section and/or on regions of the side wall sections, which regions adjoin the connecting section directly, in such a way that the predefined direction is parallel to the flow direction during the flight of the aircraft. A flow duct is then formed which is open on one side perpendicularly with respect to the predefined direction, and the air can also flow in this embodiment through the body and therefore the antenna arrangement overall in the predefined direction through the flow duct.

This embodiment of the antenna arrangement has the advantage that, on account of its open structure, the body has a lower weight than a radome of known antenna arrangements with comparable dimensions. The weight in the state in which it is mounted on an aircraft is decreased further by virtue of the fact that the antenna arrangement can dispense with a metallic base plate. A greatly reduced fuel consumption advantageously results by way of this and by way of the lower aerodynamic drag which results from the possibility that, during operation of the aircraft, the air can flow relatively freely through the body and the antenna arrangement on account of the open structure of the body and the use of printed circuit board antennas instead of mechanically rotatable antennas. Moreover, the aerodynamic forces which act on the antenna arrangement during operation of the aircraft are reduced by way of the embodiment. As a result, it is possible in an advantageous way for special reinforcements of the exterior skin of the aircraft in the region of the antenna arrangement to be dispensed with or for the requirements made of them to at least be lowered. In addition, the aerodynamic influences on adjacent antenna arrangements are lowered. The aerodynamic properties of the antenna arrangement can be improved further by virtue of the fact that the edges of the side wall sections which point in and counter to the predefined direction are chamfered.

Moreover, the costs which are associated with the antenna arrangement are lower and the installation complexity is reduced, since the antenna arrangement can be fastened to the exterior skin as a unit without a metallic base plate being connected in between, and the number of parts overall is lower. It is possible here in a simple way to configure the body in such a way that it can be fastened to (for example, standardized) arrangements of fastening elements which are present on the exterior skin of aircraft for fastening metallic base plates of existing antenna arrangements, with the result that no special requirements have to be made of the aircraft, to which the antenna arrangement is to be fastened.

In addition, it is possible in a simple way by way of suitable arrangement of the antennas on or in the side wall sections or, in the case of the H-shape, the connecting section for the antennas which have a relatively lower safety level to be held spaced apart from the exterior skin which has a safety-critical relatively higher safety level. As a result, the antennas can be of simpler configuration. Cooling of the antennas by way of the air flow which flows through the body during operation of the aircraft is also possible in a simple way here.

In contrast to antenna arrangements with radomes which have ventilation openings, the open configuration of the body reduces or avoids, moreover, the risk of dirt collecting in the antenna arrangement during operation.

Finally, it is possible in a simple way to provide a status indicator light, since parts of the printed circuit boards of the antennas are accessible from the outside. Here, the status indicator light can be arranged in an advantageous way at a location which is normally arranged in the shadow of the body during operation.

In one preferred embodiment, each of the antennas is fastened either on a side of one of the side wall sections which faces the other one of the side wall sections, or on the connecting section in the case of the U-shape on a side which faces the interior of the U-shape. This achieves a situation where no part of a respective antenna increases the external dimensions of the body even if a part of the relevant antenna projects from the body.

In one preferred embodiment, one, a plurality of, or preferably all of the antennas in each case is/are fastened to the body by the relevant antenna being embedded completely or partially into the body. In the case of a complete embedding, the antenna is enclosed completely by the material of the body. In the case of a partial embedding, the relevant antenna is arranged in a depression in the body, and projects partially out of the depression or is accessible through the opening of the depression. This embodiment advantageously provides protection for the antennas, and the aerodynamic drag of the antenna arrangement can be reduced further. It can be advantageous, in the case of a partial embedding, to configure this to be such that the relevant antenna element is flush or substantially flush with the outer side of the body. In this way, the drag can be minimized.

In one preferred embodiment, one, a plurality of, or preferably all of the antennas in each case has/have a cooling element. Each of the antennas is embedded into the body in such a way that only the cooling element projects completely or at least one part of the cooling element projects from the body. In accordance with the abovementioned preferred embodiment, in the case of an antenna which is embedded into one of the side wall sections, the cooling element projects from that side of the side wall section which faces the other one of the side wall sections and, in the case of an antenna which is embedded into the connecting section of a U-shaped body, from a side which faces the interior of the U-shape. By way of the embodiment, the cooling of the respective antennas by way of the air stream during operation of the aircraft can be improved further. It is also optionally possible, however, that the cooling element is flush or substantially flush with the outer side of the body, in order to minimize the drag. A cooling effect is still achieved as long as the air flow runs over the exposed part of the cooling element.

In one preferred embodiment, the body is of single-piece or monolithic configuration. In particular, the side wall sections and the connecting section are not configured as separate components which are fastened to one another, but are rather an integral constituent part of a single unit.

In one preferred embodiment, the body comprises a plastic material and/or a composite material which is reinforced with glass fibers, quartz fibers, ceramic fibers or aramid fibers, or is configured from one or more of the materials, preferably from a glass fiber-reinforced composite material. In contrast to metallic bodies, the coefficient of thermal expansion can advantageously be selected in such a way that it is similar to the coefficient of thermal expansion of the exterior skin or the fuselage of the aircraft if the latter is configured from a carbon fiber-reinforced plastic material. In every case, weight can be saved by way of the selection of the materials, and a relatively high elasticity of the body can be provided, by way of which the installation complexity can be reduced further, since the body and therefore the antenna arrangement can be adapted to a certain extent to deformations of the exterior skin which occur during operation, or can compensate for manufacturing tolerances.

In this embodiment, it is particularly preferred if the body comprises a composite material which is reinforced with glass fibers, quartz fibers, ceramic fibers or aramid fibers, preferably a glass fiber-reinforced composite material, which encloses a core made from a foam material or a honeycomb material.

In one preferred embodiment, the maximum extent of the connecting section in the predefined direction is smaller than the maximum extent of the side wall sections in the predefined direction. As an alternative, however, it is also possible that the maximum extent of the connecting section in the predefined direction is greater than the maximum extent of the side wall sections in the predefined direction.

In one preferred embodiment, at least one of the antennas is fastened to the connecting section, and the antenna arrangement has, furthermore, a heat conduction device, in particular a heat pipe arrangement, which is arranged on or in the body and connects the at least one antenna which is fastened to the connecting section to one or more heat sinks which is/are arranged on one of the or both side wall sections. Heat sinks of this type can be, for example, cooling elements of antennas which are fastened to the side wall sections or are embedded into the latter, as has been described above, or else one or more separate cooling elements which are fastened to the side wall sections.

In one preferred embodiment, in which the body is H-shaped if it is viewed from the predefined direction, the connecting section is arranged closer to the first edges of the side wall sections than to two second edges of the side wall sections which form the other free ends of the H-shape on the second side of the connecting section which lies opposite the first side of the connecting section. In this case, in the state of the antenna arrangement in which it is mounted on an exterior skin of an aircraft, the connecting section is arranged closer to or completely or partially in the boundary layer of the flow on the exterior skin, as a result of which the aerodynamic drag of the antenna arrangement can be reduced further. In return, however, it becomes more difficult in some circumstances to ensure sufficient cooling of antennas which are fastened to the connecting section, with the result that the abovementioned heat conduction device and therefore a combination with the correspondingly above-described embodiment is advantageous.

In one preferred embodiment, each of the antennas is in each case a KU-band, KA-band or L-band antenna.

The antenna arrangement in accordance with one of the above-described embodiments is part of an aircraft in the installed state. According to the disclosure herein, an aircraft with an exterior skin and an antenna arrangement in accordance with one of the embodiments described herein is therefore also provided. The antenna arrangement is fastened directly to the outer side of the exterior skin of the aircraft at the two first edges of the side wall sections in such a way that the predefined direction is parallel to the flow direction during the flight of the aircraft. This possibility is preferred both for the U-shape and for the H-shape. In the case of the U-shape, however, it is also possible as an alternative that the antenna arrangement is fastened directly to the outer side of the exterior skin of the aircraft on the connecting section and/or regions of the side wall sections, which regions adjoin the connecting section directly, in such a way that the predefined direction is parallel to the flow direction during the flight of the aircraft.

In one preferred embodiment of the aircraft, the latter, furthermore, has an arrangement of fastening elements on the outer side of the exterior skin, the antenna arrangement being connected to the fastening elements on the two first edges of the side wall sections or, in the case of the U-shape, being connected as an alternative to the fastening elements on the connecting section and/or regions of the side wall sections, which regions adjoin the connecting section directly. The fastening elements can be configured, for example, in a standard arrangement or standard configuration, such as for instance in an ARINC 791 or ARINC 792 arrangement.

The aircraft can have one or more of the antenna arrangements. Here, the antenna arrangement can be provided at various locations on the aircraft and, for example, at various locations on the fuselage of the aircraft, for example on the upper side, on the lower side or laterally. The same applies to an arrangement on or in other parts of the aircraft, such as, for example, a tail fin or a wing.

BRIEF DESCRIPTION OF THE DRAWINGS

In the following text, the disclosure herein will be described in greater detail with reference to the figures, in which various exemplary embodiments are shown.

DETAILED DESCRIPTION

Figure 1:
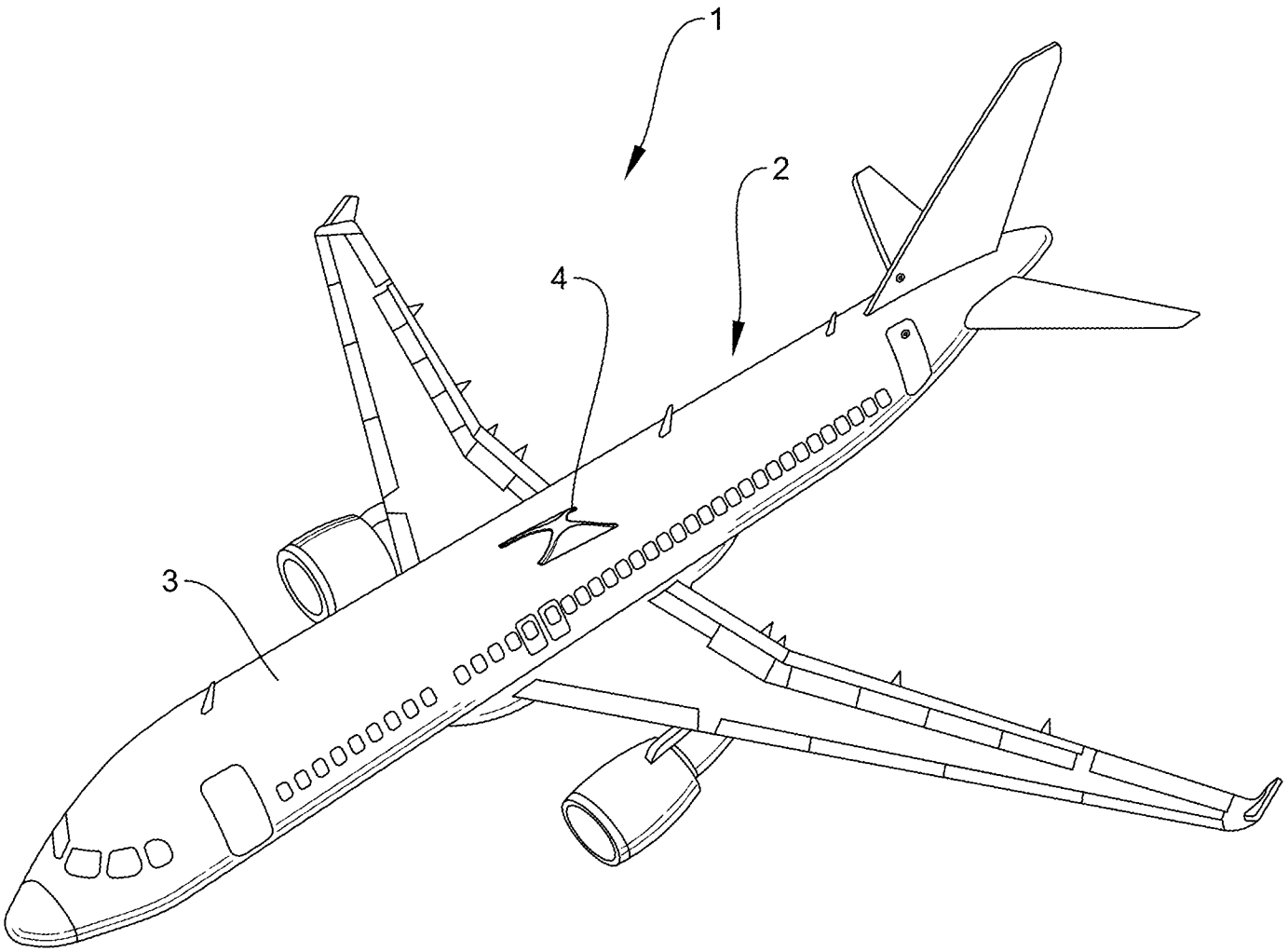
FIG. 1 shows a diagrammatic perspective view of an aircraft with an antenna arrangement according to the disclosure herein.

The aircraft 1 which is shown in FIG. 1 has a fuselage 2 with an exterior skin 3, on the outer side of which an antenna arrangement 4 according to the disclosure herein is mounted. The antenna arrangement 4 and a section of the exterior skin 3, on which section the antenna arrangement is mounted, are shown in an enlarged view in FIG. 2A.

The antenna arrangement 4 has a body 5 and, in this exemplary embodiment, three various printed circuit board antennas 6 which can be oriented electronically. For its part, the body 5 which is produced in one piece, for example, from a glass fiber-reinforced composite material has two plate-shaped side wall sections 7 and a likewise plate-shaped connecting section 8 which connects them. Each of the two side wall sections 7 is fastened on a first edge 9 to the exterior skin 3, in order to fasten the body 5 overall to the exterior skin 3. The fastening can take place, in particular, by the first edges 9 being provided with fastening devices (not shown in the figure) which match an arrangement (likewise not shown in the figure) of corresponding fastening devices which are provided on the exterior skin 3. The latter fastening devices can be, for example, fastening projections or attachments.

The extent of the two side wall sections 7 in a predefined direction 10 is greatest in each case on their first edge 9, that is to say directly adjacently with respect to the exterior skin 3, and they taper in each case with an increasing spacing from their first edge 9 and the exterior skin 3. As a result, the two side wall sections 7 have a ramp shape on their edges 11 which point counter to the predefined direction 10 or in the predefined direction 10, that is to say in relation to the direction 10 on their front and rear edge 11. The body 5 is fastened to the exterior skin 3 in such a way that the predefined direction 10 is the direction of the air flow when the aircraft 1 is flying. Therefore, the ramp shape of the edges 11 has the advantage of reducing the drag of the antenna arrangement 4.

As can be seen, the maximum extent of the connecting section 8 in this embodiment in the predefined direction 10 is smaller than the maximum extent of the side wall sections 7 in this direction.

It can also be seen that, during the flight of the aircraft 1, air can flow in a substantially unimpeded manner along the predefined direction 10 through the body 5, and that the body 5 has a greatly reduced drag in comparison with a radome of comparable dimensions which is closed or provided merely with ventilation openings. If the body 5 is observed along the predefined direction 10, it has a U-shape, as can already be seen from FIG. 2A and can be gathered in an improved manner from FIG. 2B, in which the printed circuit board antennas 6 are not shown for reasons of simplicity and which shows a view of the antenna arrangement substantially along the predefined direction 10. The duct which is formed by way of the U-shape and the exterior skin 3 makes it possible for air to flow through the antenna arrangement.

Figure 2A:
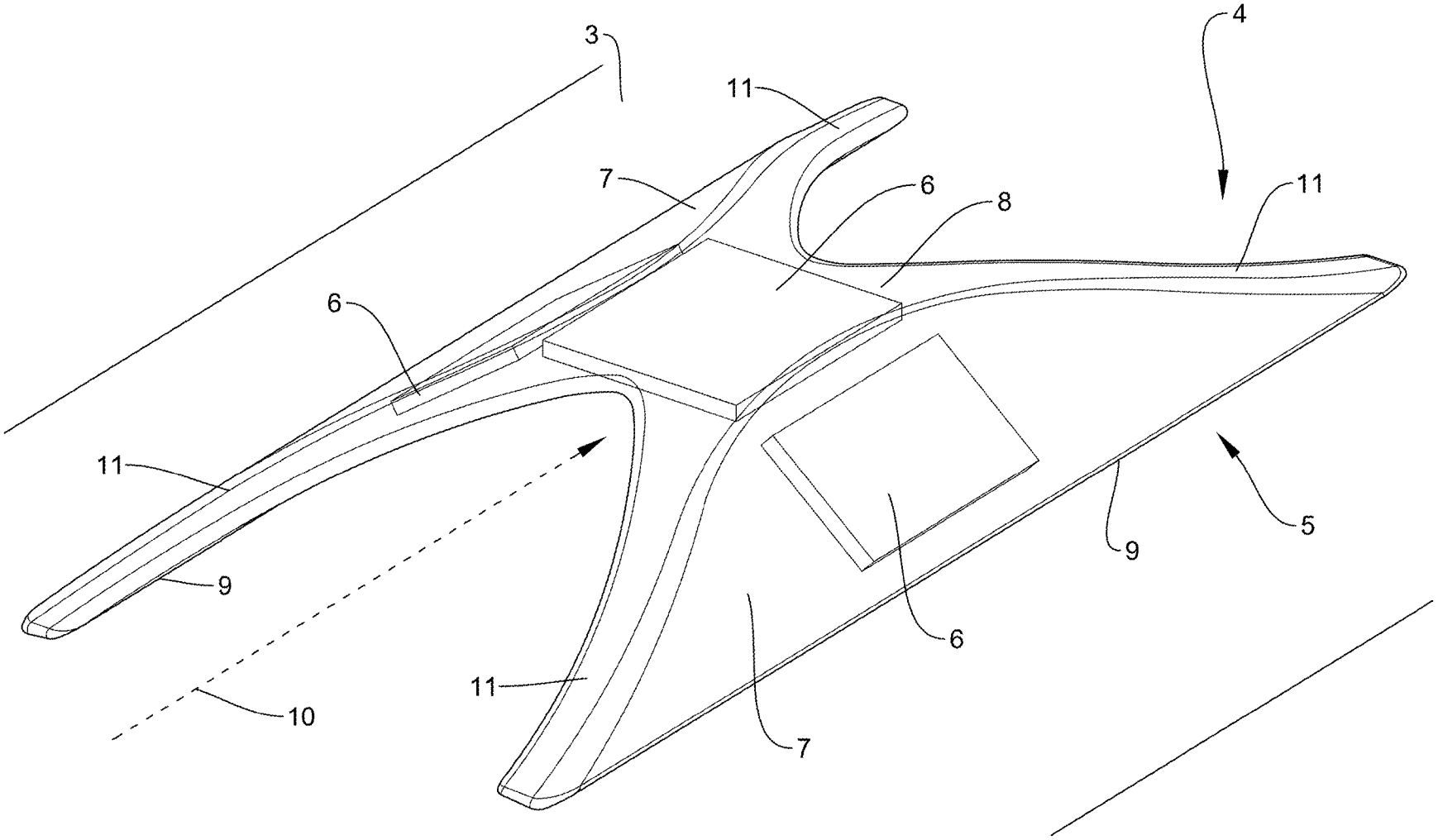
FIG. 2A shows a diagrammatic perspective view of an antenna arrangement in accordance with a first exemplary embodiment of the disclosure herein, which antenna arrangement is fastened to a section of an exterior skin of the aircraft.

It can also be seen in FIG. 2A that in each case one of the printed circuit board antennas 6 is arranged on and fastened to another one of the side wall sections 7, and the third printed circuit board antenna 6 is arranged on and fastened to the connecting section 8. As a result, the three printed circuit board antennas 6 are oriented in each case in accordance with the orientation of the corresponding section 7, 8, with the result that they have different orientations and therefore have different spatial emitting and receiving properties. The printed circuit board antennas 6 can be, for example, transmitting and receiving antennas. It is also possible, however, to provide not only one printed circuit board antenna 6 on each of the side wall sections 7 and the connecting section 8, but rather two printed circuit board antennas, one for transmitting and one for receiving. Two printed circuit board antennas 6 of this type can then be fastened, in particular, next to one another to the corresponding one of the sections 7, 8.

Figure 3:
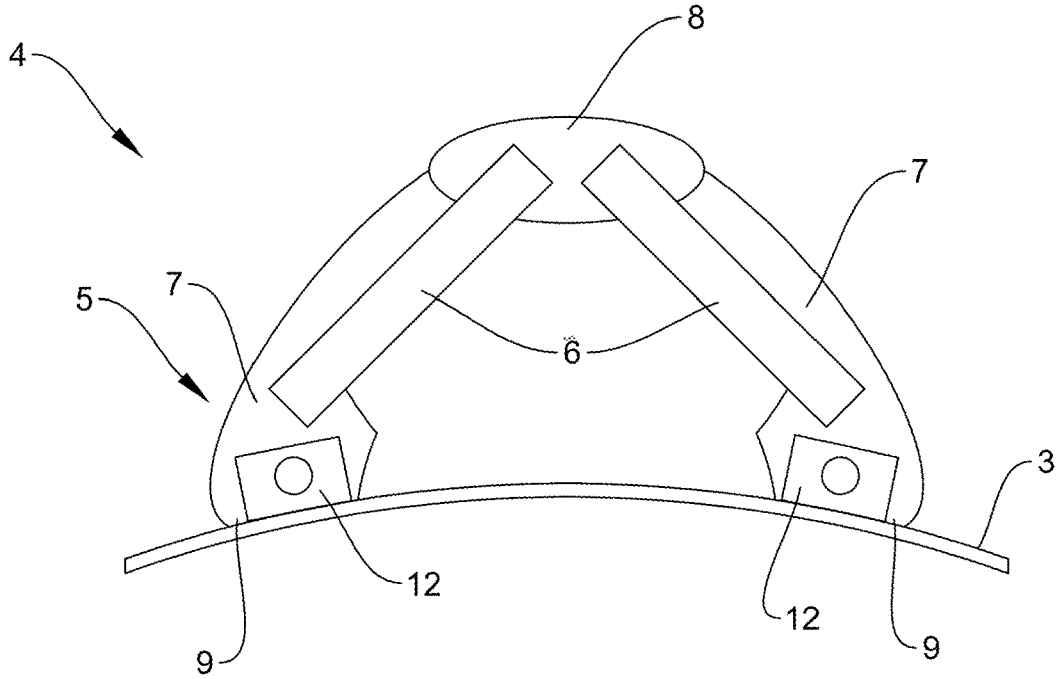
FIG. 3 shows a diagrammatic cross-sectional view of a first variant of the embodiment of FIG. 2A.
Figure 4:
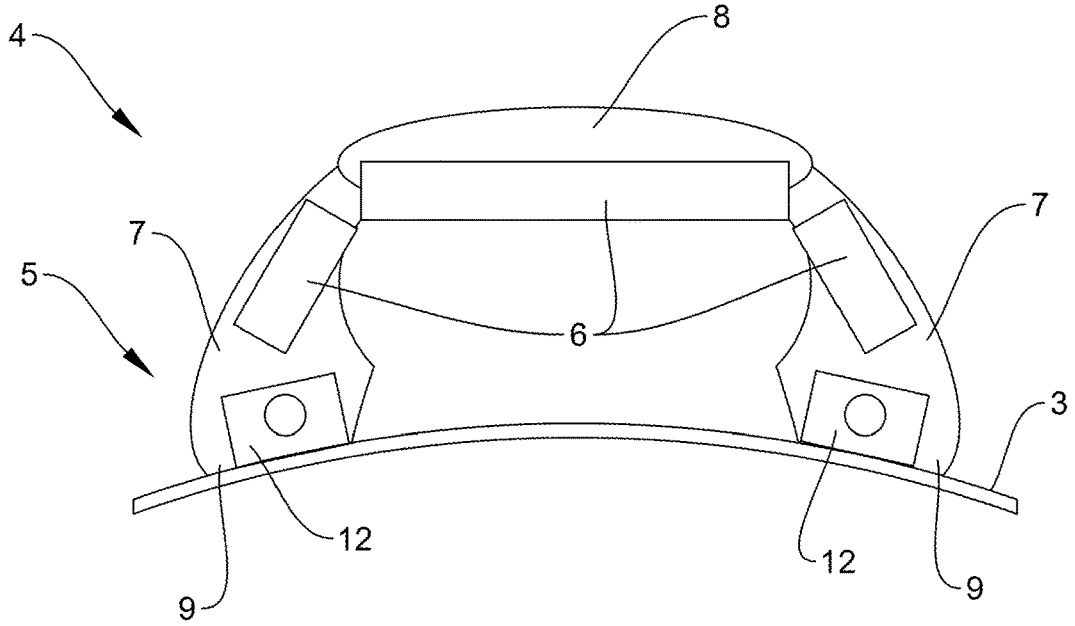
FIG. 4 shows a diagrammatic cross-sectional view of a second variant of the embodiment of FIG. 2A.
Figure 5:
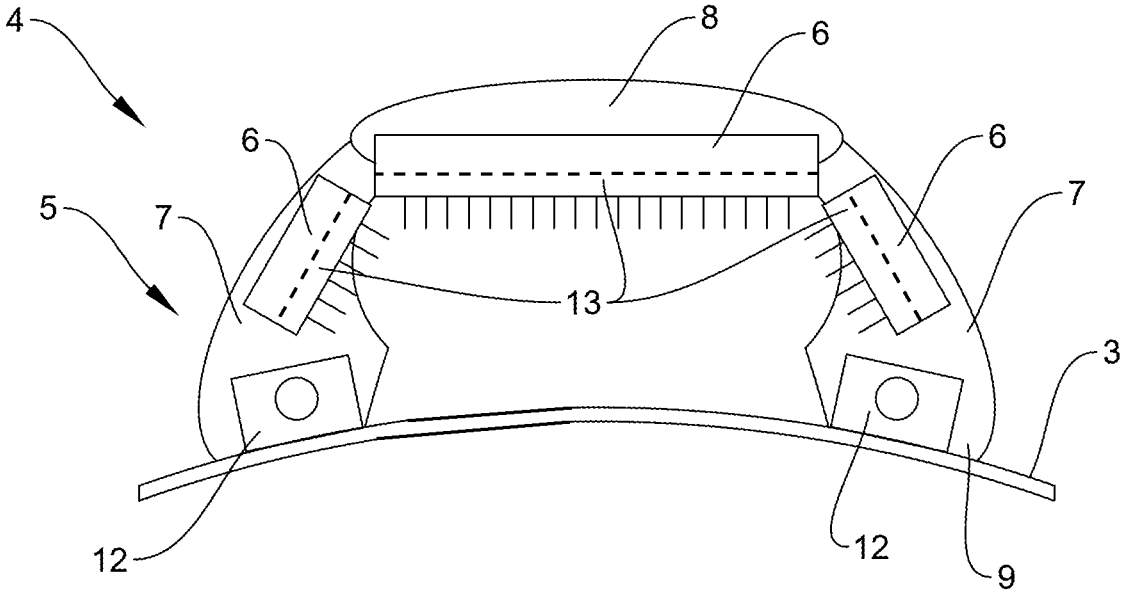
FIG. 5 shows a diagrammatic cross-sectional view of a variant of the antenna arrangement of FIG. 4.

As is indicated in FIG. 2A and can be seen in an improved manner in FIGS. 3 to 5, the printed circuit board antennas 6 are in each case embedded partially into the body 5 or arranged in a respective depression which is provided in the body 5, in such a way that they project partially out of the surface of the side wall section 7 or connecting section 8 which faces the exterior skin 3, that is to say out of the lower side of the body 5. It is also possible, however, that the printed circuit board antennas 6 are embedded completely into the body 5.

Figure 2B:
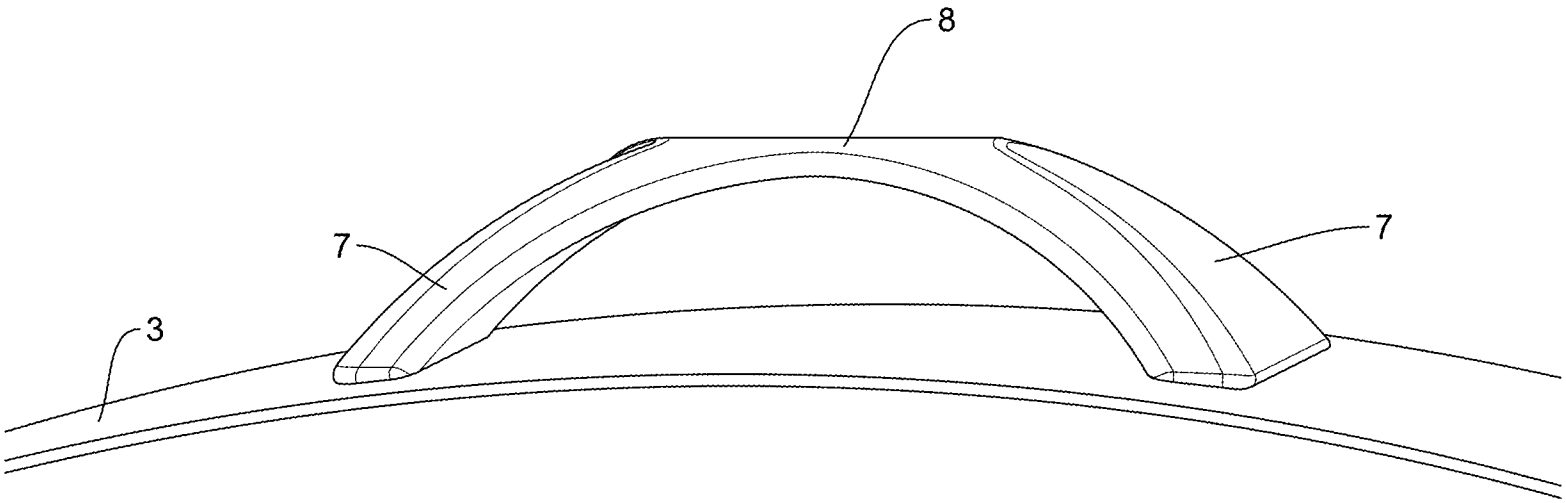
FIG. 2B shows a lateral view of the antenna arrangement and exterior skin of FIG. 2A.

In each case in a cross-sectional view perpendicularly with respect to the predefined direction 10, FIGS. 3 and 4 show two different variants of the embodiment of FIGS. 2A and 2B which differ in terms of their U-shape. In particular, the two variants differ by virtue of the fact that three printed circuit board antennas 6 as in FIG. 2A and FIG. 4 are not provided in FIG. 3, but rather merely two, in each case one in each of the two side wall sections 7. In comparison with FIG. 4, the connecting section 8 in FIG. 3 has a smaller extent in a direction perpendicularly with respect to the predefined direction, with the result that the U-shape is narrower and is approximately V-shaped. In return, the extent of the side wall sections 7 in the direction perpendicularly with respect to the predefined direction 10 between the exterior skin 3 and the connecting section 8 in FIG. 4 is smaller than in FIG. 3, with the result that the printed circuit board antennas 6 which are arranged in the side wall sections 7 also have correspondingly smaller dimensions.

Both FIG. 3 and FIG. 4 show fastening projections 12 which are fastened to the exterior skin 3 in a predefined arrangement, and to which in turn the first edges 9 of the side wall sections 7 of the body 5 are fastened.

FIG. 5 shows one variant of the embodiment of FIG. 4, in which the printed circuit board antennas 6 in each case have a cooling element 13, with which they project inwards from the side wall sections 7 or the connecting section 8, with the result that, during the flight of the aircraft 1, they are situated in the air flow which then flows through the duct which is defined by way of the U-shape and the exterior skin 3. As a result, the cooling effect of the air flow for the printed circuit board antennas 6 which also exists in the embodiments of FIGS. 3 and 4 is improved.

Figure 6A:
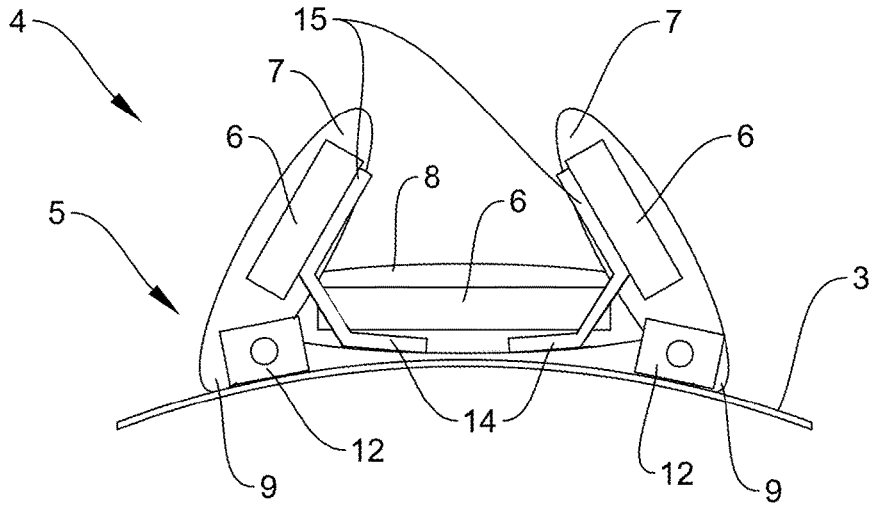
FIG. 6A shows a diagrammatic cross-sectional view of a third variant of the embodiment of FIG. 2A.
Figure 6B:
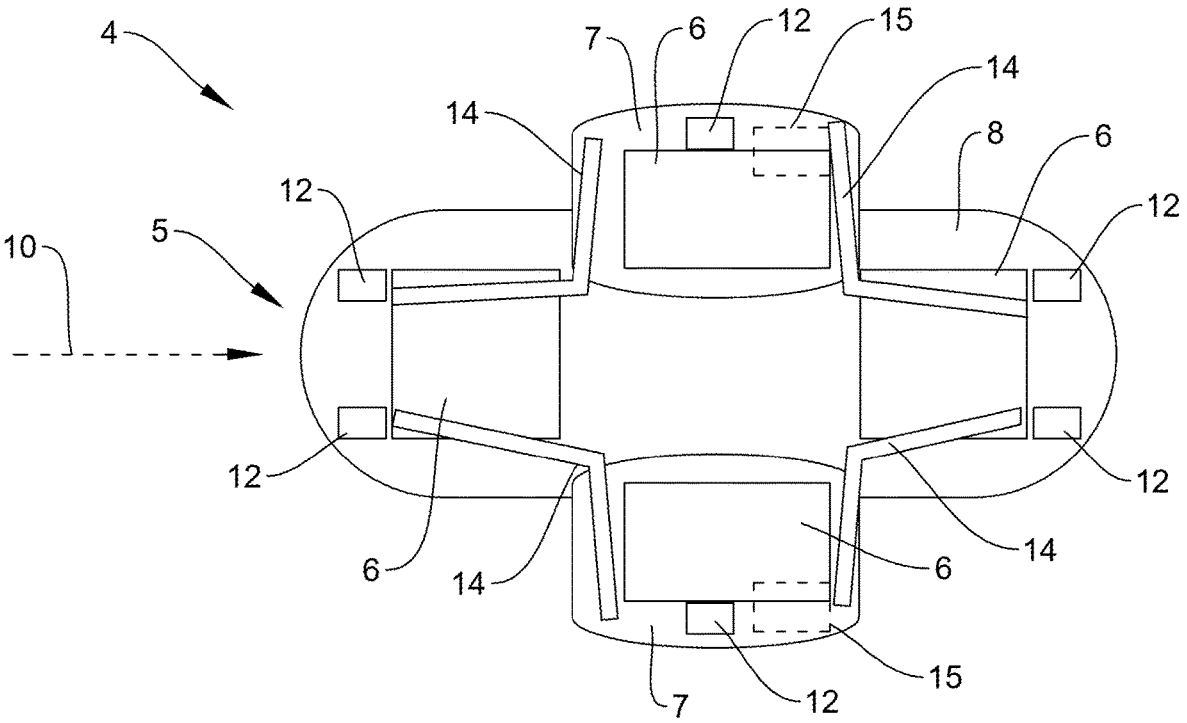
FIG. 6B shows a diagrammatic plan view of the antenna arrangement of FIG. 6A.

FIGS. 6A and 6B show a cross-sectional view perpendicularly with respect to the predefined direction 10 and in a diagrammatic plan view (from above in FIG. 6A) of a further variant of the embodiment of FIG. 2A. As can be seen from FIG. 6B, in contrast to FIG. 2A, the maximum extent of the connecting section 8 in the predefined direction 10 is initially greater than the maximum extent of the side wall sections 7 in the predefined direction 10. Moreover, two printed circuit board antennas 6 are arranged on the longer connecting section 8, whereas one printed circuit board antenna 6 is still arranged on each of the two side wall sections 7, with the result that the overall antenna arrangement 4 comprises four printed circuit board antennas 6.

Moreover, if it is viewed along the predefined direction 10 (see FIG. 6A), the body 5 has an H-shape, since the connecting section 8 does not connect the side wall sections 7 at their ends which lie opposite the first edges 9, but rather between the ends and the edges 9 in a region which lies closer to the edges 9. In this way, the connecting section 8 and therefore also the printed circuit board antennas 6 which are arranged on it are arranged closer to the exterior skin 3 and preferably in the boundary layer region of the air flow, with the result that the drag can be reduced further. On account of this, however, the cooling of the two printed circuit board antennas 6 which are arranged on the connecting section 8 by way of the air flow is also impaired. Therefore, in this embodiment, the antenna arrangement has heat pipes 14 or other heat conduction devices which are provided on the body 5 and in each case connect the two printed circuit board antennas 6 which are arranged on the connecting section 8 to a heat sink 15, which heat sinks 15 are provided on the side wall sections 7, for example in the form of a cooling element.

It can also be seen in FIG. 6B that the connecting section 8 can likewise be connected at its ends to fastening attachments 12 which project from the exterior skin 3.

While at least one example embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An antenna arrangement for an aircraft for fastening to an outer side of an exterior skin of the aircraft, the antenna arrangement comprising:

a body configured from one or more non-metallic materials, and two plate-shaped side wall sections and a connecting section which connects them, which are arranged such that the body is U-shaped or H-shaped if viewed from a predefined direction; and one or more antennas in a form of a printed circuit board and of which each is fastened to the body;

wherein the antenna arrangement can be fastened directly to the outer side of the exterior skin of the aircraft at two first edges of the side wall sections which form two free ends of the U-shape or H-shape on a first side of the connecting section or, in case of the U-shape, on the connecting section and/or regions of the side wall sections, which regions adjoin the connecting section directly, such that the predefined direction is parallel to a flow direction during flight of the aircraft.

2. The antenna arrangement according to claim 1, wherein each of the antennas is fastened either on a side of one of the side wall sections which faces another one of the side wall sections, or on the connecting section in case of the U-shape on a side which faces an interior of the U-shape.

3. The antenna arrangement according to claim 1, wherein at least one of the antennas is fastened to the body by being embedded completely or partially into the body.

4. The antenna arrangement according to claim 1, wherein at least one of the antennas has a cooling element and is embedded into the body such that only the cooling element or a part of the cooling element projects from the body.

5. The antenna arrangement according to claim 1, wherein the body is of single-piece or monolithic configuration.

6. The antenna arrangement according to claim 1, wherein the body comprises a plastic material and/or a composite material which is reinforced with glass fibers, quartz fibers, ceramic fibers or aramid fibers, or is configured from one or more of the materials.

7. The antenna arrangement according to claim 6, wherein the body comprises a composite material which is reinforced with glass fibers, quartz fibers, ceramic fibers or aramid fibers, which encloses a core made from a foam material or a honeycomb material.

8. The antenna arrangement according to claim 1, wherein a maximum extent of the connecting section in the predefined direction is smaller than a maximum extent of the side wall sections in the predefined direction.

9. The antenna arrangement according to claim 1, wherein a maximum extent of the connecting section in the predefined direction is greater than a maximum extent of the side wall sections in the predefined direction.

10. The antenna arrangement according to claim 1, wherein at least one of the antennas is fastened to the connecting section, and which antenna arrangement has a heat conduction device which is arranged on or in the body and connects the at least one antenna which is fastened to the connecting section to one or more heat sinks which is/are arranged on one of the or both side wall sections.

11. The antenna arrangement according to claim 1, wherein the body is H-shaped if viewed from the predefined direction, and in case of which the connecting section is arranged closer to the first edges of the side wall sections than to two second edges of the side wall sections which form other free ends of the H-shape on a second side of the connecting section which lies opposite the first side of the connecting section.

12. The antenna arrangement according to claim 1, wherein each of the antennas is in each case a KU-band, KA-band or L-band antenna.

13. An aircraft with an exterior skin and an antenna arrangement according to claim 1, the antenna arrangement being fastened directly to the outer side of the exterior skin of the aircraft at the two first edges of the side wall sections or, in case of the U-shape, on the connecting section and/or regions of the side wall sections, which regions adjoin the connecting section directly, such that the predefined direction is parallel to the flow direction during the flight of the aircraft.

14. The aircraft according to claim 13, comprising an arrangement of fastening elements on the outer side of the exterior skin, the antenna arrangement being fastened to the fastening elements by two first edges of the side wall sections or, in case of the U-shape, being fastened to the fastening elements by the connecting section and/or regions of the side wall sections, which regions adjoin the connecting section directly.

* * * * *